US008963431B2

(12) United States Patent
van den Berg et al.

(10) Patent No.: US 8,963,431 B2
(45) Date of Patent: Feb. 24, 2015

(54) CIRCUIT FOR DRIVING LEDS

(71) Applicant: NXP B. V., Eindhoven (NL)

(72) Inventors: Arjan van den Berg, Helmond (NL); Jie Chen, Jingmen (CN); Wihelmus Hinderikus Maria Langeslag, Wijchen (NL); Anton Cornelis Blom, Eindhoven (NL); Dirk Wouter Johannes Groeneveld, Elst (NL)

(73) Assignee: NXP B.V., Eindhoven (NL)

( * ) Notice: Subject to any disclaimer, the term of this patent is extended or adjusted under 35 U.S.C. 154(b) by 30 days.

(21) Appl. No.: 13/848,448

(22) Filed: Mar. 21, 2013

(65) Prior Publication Data

US 2014/0125235 A1 May 8, 2014

(30) Foreign Application Priority Data

Mar. 30, 2012 (EP) ..... 12162644

(51) Int. Cl.
*H05B 37/00* (2006.01)
*H05B 37/02* (2006.01)
*H05B 33/08* (2006.01)

(52) U.S. Cl.
CPC ..... *H05B 33/0806* (2013.01); *H05B 33/0809* (2013.01); *H05B 33/083* (2013.01)
USPC ..... 315/122; 315/185 R; 315/193; 315/306; 315/186; 315/291; 315/297; 315/307

(58) Field of Classification Search
CPC ..... H05B 37/00; H05B 37/02
USPC ..... 315/122, 185 R, 193, 306, 186, 291, 315/297, 307
See application file for complete search history.

(56) References Cited

U.S. PATENT DOCUMENTS

| | | | | |
|---|---|---|---|---|
| 4,567,379 | A | 1/1986 | Corey et al. | |
| 6,166,530 | A | 12/2000 | D'Angelo | |
| 8,203,283 | B2 | 6/2012 | Hoogzaad | |
| 8,207,685 | B2 * | 6/2012 | Cheng et al. | 315/306 |
| 2002/0030475 | A1 | 3/2002 | D'Angelo | |
| 2005/0073513 | A1 | 4/2005 | Date | |
| 2010/0308738 | A1 * | 12/2010 | Shteynberg et al. | 315/185 R |
| 2010/0308739 | A1 * | 12/2010 | Shteynberg et al. | 315/193 |

(Continued)

FOREIGN PATENT DOCUMENTS

| | | | |
|---|---|---|---|
| CN | 101779522 | A | 7/2010 |
| WO | 2011/053708 | A1 | 5/2011 |

OTHER PUBLICATIONS

Extended European Search Report for Application No. 12162644.4 (Aug. 16, 2012).

*Primary Examiner* — Douglas W Owens
*Assistant Examiner* — Wei Chan

(57) ABSTRACT

A circuit is disclosed for driving a plurality of LED strings from an AC supply and arranged to, in use, drive current through a series arrangement of a plurality N of the LED strings when the AC voltage is sufficient to drive the plurality N of the LED strings: the circuit comprising a first current source configured to be switchably connected to a one end of said series arrangement of N LED strings; a series combination of a second current source and a heat dissipater, wherein the series combination of the second current source and the heat dissipater is arranged in parallel with the first current source; and a current balancer for balancing the current through the first current source and the second current source. A driver for such a circuit is also disclosed.

15 Claims, 6 Drawing Sheets

(56) References Cited

U.S. PATENT DOCUMENTS

2011/0199003 A1* 8/2011 Muguruma et al. ..... 315/122
2012/0038285 A1 2/2012 Leung et al.
2012/0081009 A1* 4/2012 Shteynberg et al. ..... 315/122
2013/0002155 A1* 1/2013 Hu et al. ..... 315/186
2013/0043799 A1* 2/2013 Siu et al. ..... 315/193

* cited by examiner

CIRCUIT FOR DRIVING LEDS

CROSS-REFERENCE TO RELATED APPLICATIONS

This application claims the priority under 35 U.S.C. §119 of European patent application no. 12162644.4, filed on Mar. 30, 2012, the contents of which are incorporated by reference herein.

FIELD OF THE INVENTION

This invention relates to circuits for driving LED strings from an AC power supply, and to drivers therefor.

BACKGROUND OF THE INVENTION

High efficiency light sources, and in particular solid-state light sources such as LEDs, are increasingly replacing incandescent light sources in a wide range of applications. In contrast to incandescent (filament) lamps, such light sources generally are not directly compatible with AC power supplies and in particular the mains power available in most countries.

Conventionally, to power such light sources, an AC power source is converted into DC, typically by means of a switched mode power converter. However this adds complexity and cost to the overall system; there is an increasing interest in so-called "direct-to-mains" driving of LEDs. Since, in a mains supply both the current and voltage vary, a high voltage is available only during a part of the mains cycle. So, in order to be able to drive at least some of the LEDs across more of the mains cycle, the LEDs are grouped into strings of series-connected LEDs. Once the mains voltage is sufficient to power a first string of LEDs, that string is connected to the supply. As the supply voltage rises a second string of LEDs is switched to be in series with the first string. Thereafter at a still higher mains voltage a third string is connected in series with both the first and second string, and so on until all of the strings are connected in series, for the high-voltage part of the AC supply cycle. Then, as the supply voltage starts to fall, strings are sequentially switched out of the series arrangement until just one string is connected across the supply. Towards the end of the cycle—and the beginning of the next cycle—when the voltage is insufficient to illuminate even one string, no strings are supplied. This is generally termed a "linear LED driver", and it shown schematically in FIG. 1. The figure shows an AC supply voltage, each half-cycle of which is split into several segments or regions. During the regions labelled 1-4, one, two, three and then four strings are connected respectively; in region 5 only three strings are connected; in region 6 just two strings are connected and in region 7, one string only is connected. It will be appreciated that the stepped current profile shown in FIG. 1 is for illustration purposes; in general, the current will more closely follow the mains voltage shape, for higher efficiency, although in principle, the current could be linear, or constant, It is generally preferred to provide a constant current supply to a string of LEDs rather than a constant voltage, since, among other reasons, the output light flux more closely follows the current through the device than the voltage across it. The driver and control circuit for such an arrangement generally includes a current source and one or more switches to direct the current to the relevant series combination of strings, which combination thus changes during the supply cycle. During the parts of the supply cycle where in the supply voltage is not exactly matched to the LEDs strings, the excess voltage is dropped in the driver. This voltage can correspond to a significant power which is thus dissipated as heat energy in the driver and/or controller.

SUMMARY OF THE INVENTION

According to a first aspect there is provided a circuit, for driving a plurality of LED strings from an AC supply and arranged to, in use, drive current through a series arrangement of a plurality N of the LED strings when the AC voltage is sufficient to drive the plurality N of the LED strings: the circuit comprising a first current source configured to be switchably connected to said series arrangement of N LED strings and in particular to a one end of said series arrangement of N LED strings; a series combination of a second current source and a heat dissipater, wherein the series combination of the second current source and the heat dissipater is arranged in parallel with the first current source; and a current balancer for balancing the current through the first current source and the second current source.

Thus, according to this aspect, at least some of any excess power resulting from a mismatch between the AC supply voltage and the voltage required to drive the LED string or strings with an appropriate current, may be dissipated in a heat dissipater, which may be a resistor or a power resistor, rather than elsewhere in the circuit. It may thereby be possible to simplify the thermal management of the circuit and in particular, the thermal design of the driver or controller.

In embodiments, the circuit comprises at least one further series combination of a respective further current source and a respective further heat dissipater, wherein the further series combination is arranged in parallel with the first current source, and wherein the current balancer is configured to balance the current through the first current source, and second current source and the at least one further current source. Thus it may be possible to utilise two or more heat dissipaters, instead of a single heat dissipater. In the case, for instance and without limitation, of power resistors as heat dissipaters this may facilitate use of lower specification and thus cheaper components.

The plurality of LED strings may consist of 2 LED strings. Alternatively it may consist of M strings, where M is more than two, in which case, in use, N may increase with increasing voltage of the AC supply to a maximum M, and when N is equal to M the entire plurality of LED strings are driven. Without limitation, M may be between 2 and 3. Additional strings entail more complexity, although may allow for a high power conversion efficiency, A conversion efficiency of around 80% is achievable with 3 strings. In general and in its simplest form, the number of strings M required is such that the peak mains voltage Vmains(peak), equivalent to √2*Vrms, is dropped across the sum of the string voltages Vstring:

$$M = V\text{mains(peak)}/V\text{string}.$$

In order to allow for headroom, a correction factor of 0.4 may be applied:

$$(M+0.4) = V\text{mains(peak)}/V\text{string}.$$

In embodiments, when the AC voltage is sufficient to drive one LED string only, current may be supplied to the LED string only through a series combination of a current source and a heat dissipater.

In embodiments, there are for each different value of N, different first current sources, and different series combinations of second current source and heat dissipater. Thus a first current source and a second current source, and in particular a electrical resistive value of the heat dissipater associated with the second current source, may be specific to one series combination of LED strings. The different current sources may be physically different sources, which provide the same current value; or may be physically different sources which provide different values of current.

In embodiments the first current source comprises a first transistor and the second current source comprises a second transistor, the first and second transistors having commonly connected emitters. Considered individually, the transistors may operate in linear mode having resistive behaviour, with their respective control terminals determining the magnitude of the resistance and thus the current through each. It will be appreciated that although the transistors are acting to provide a current and thus may be properly termed as being comprised in current sources, they are not, in general, operating in saturated mode, but rather they are operating in linear mode.

In embodiments the circuit is configured such that in use the sum of the currents I1 and I2 through the first and second current source is controlled by a voltage reference Vref and a sense resistance Rsense, according to: I1+I2=Vref/Rsense, and the current balancer is operable to control the second transistor to control I1, according to a voltage at the commonly connected emitters.

According to another aspect, there is provided an LED driver configured use in a circuit described and comprising a first current source; a second current source; and a current balancer for balancing the current through the first current source and the second current source. The driver may comprise at least one further current source, in which case the current balancer may be for balancing the current through the first current source, the second current source and the at least one further current source. In particular, the driver need not comprise any heat dissipaters, which, in use, may be provided elsewhere in the circuit. Thus according to this aspect, since there may be lower heat dissipation in the driver, it may be possible to package the driver in a relatively lower specification package than in the prior art.

According to a yet aspect, there is provided a method of operating a circuit or a driver as described above. In particular, there may be provided A method of driving a plurality of LED strings from an AC supply and comprising: driving current through a series arrangement of a plurality N of the LED strings when the AC voltage is sufficient to drive the plurality N of the LED strings, and balancing the current through a first current source and a second current source; wherein the first current source is configured to be switchably connected to said series arrangement of N LED strings, and a series combination of the second current source and a heat dissipater is arranged in parallel with the first current source.

These and other aspects of the invention will be apparent from, and elucidated with reference to, the embodiments described hereinafter.

BRIEF DESCRIPTION OF DRAWINGS

Embodiments of the invention will be described, by way of example only, with reference to the drawings, in which.

Figure 1:
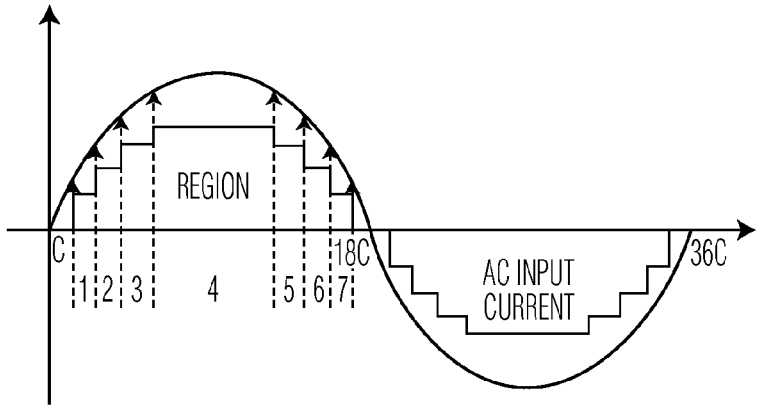
FIG. 1 illustrates the segmentation of an AC power supply, when used to drive series-connected strings of LEDs.

It should be noted that the Figures are diagrammatic and not drawn to scale. Relative dimensions and proportions of parts of these Figures have been shown exaggerated or reduced in size, for the sake of clarity and convenience in the drawings. The same reference signs are generally used to refer to corresponding or similar feature in modified and different embodiments

DETAILED DESCRIPTION OF EMBODIMENTS

Figure 2:
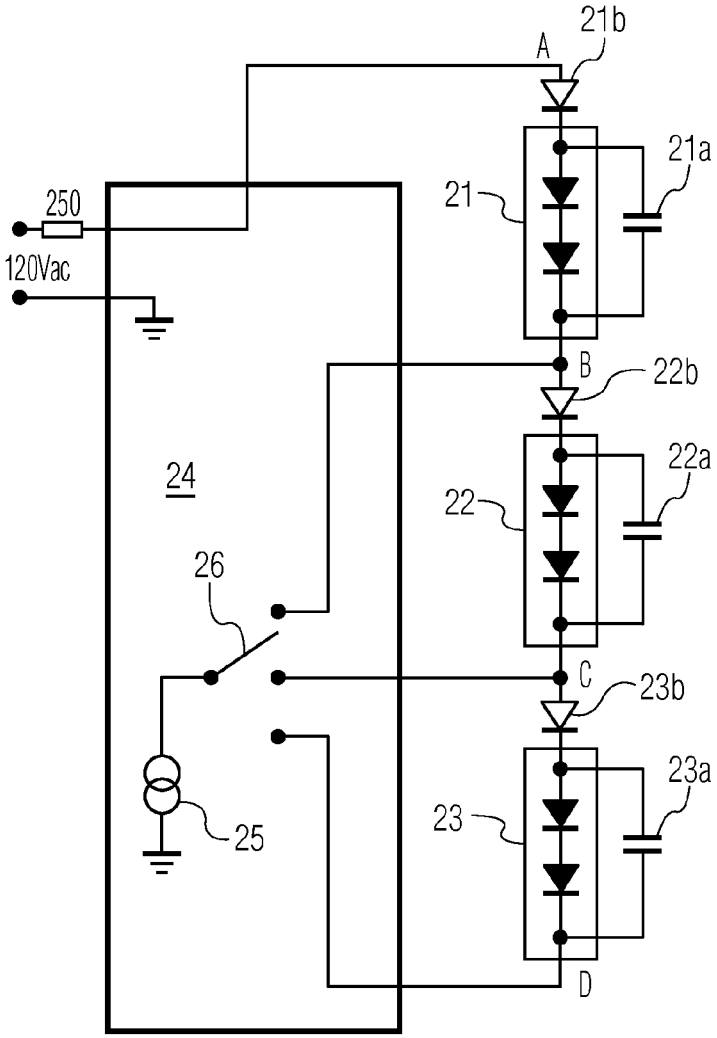
FIG. 2 shows, schematically, an arrangement for a "direct to mains" LED arrangement.

FIG. 2 shows, schematically, an arrangement for a "direct to mains" LED arrangement. The arrangement 20 comprises LED strings 21, 22 and 23. Each LED string comprise a series arrangement of LEDs and may have a capacitor 21*a*, 22*a* and 23*a* thereacross together with a series-connected protective diode 21*b*, 22*b* and 23*b*, as will be well-known to the skilled person, in order to filter out 100 Hz, or more generally mains, ripple. This may otherwise be apparent in view of the fast optical response of LEDs in general. As an example, each string may comprise about 17 LEDs (for a three-string arrangement of LEDs each dropping about 3V in operation, design for use with a 120V mains such that the optimum forward voltage of all strings in series would be around 140V) although other suitable numbers may be provided in each string. In general, the number of LEDs in each string will be determined based on the choice of the number of strings, and the mains voltage Further, the string may comprise one or more so-called HV-LEDs in which a single package comprises a series arrangement of two or more LEDs. Normally, but not necessarily, each string includes the same number of LEDs. The strings 21, 22 and 23 are connected in series, with nodes B and C therebetween. The AC input, such as a 120 V AC mains supply, is provided to the driver and one terminal of the mains is connected to one end A of the series arrangement of strings. It will be appreciated that in this figure only single side rectification is shown, for reasons of clarity. In general, the mains voltage is preferably rectified by a full bridge rectifier.

The arrangement further comprises a driver 24. The driver may comprise a controller and driving functionality. The driver includes a current source 25. Current from the current source is routed to one or more of the LED strings by means of switch 26. As shown, switch 26 may route the current through just the first LED string 21, via node B; it may route the current through both the first and second LED strings, 21 and 22, via node C; finally the switch may route the current through all the strings via node D at the end of the series combination furthest from node A.

Figure 3:
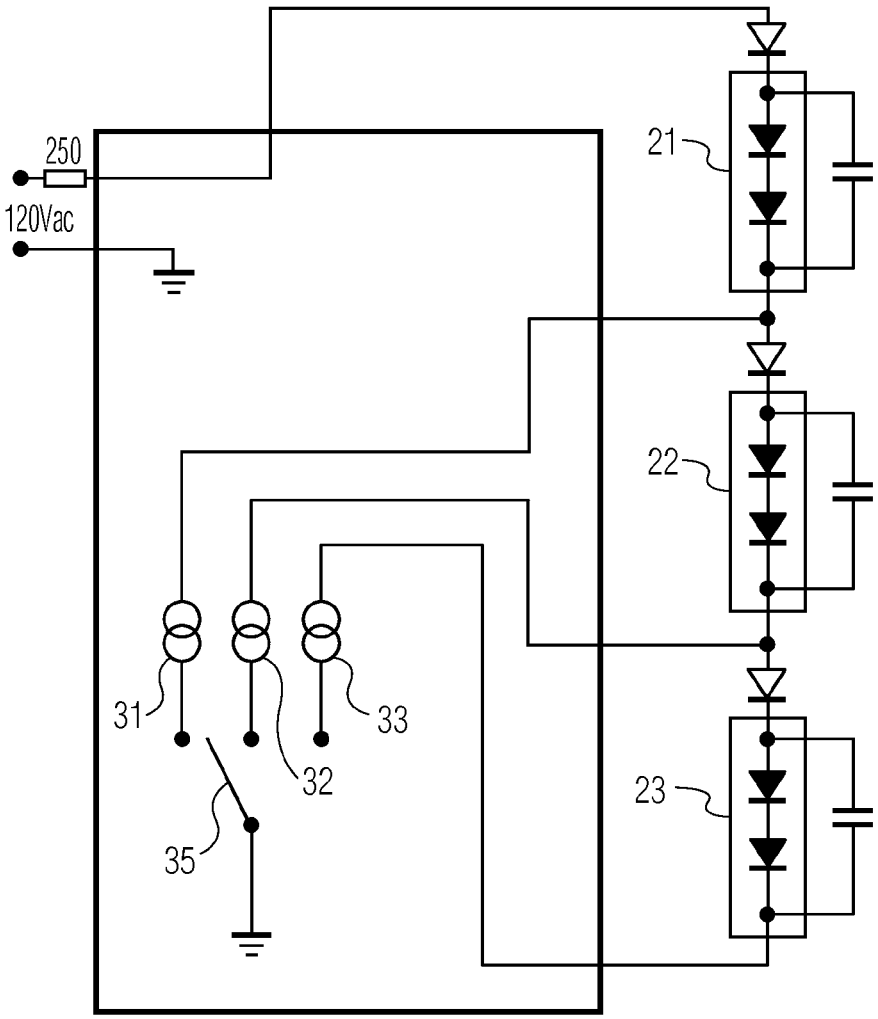
FIG. 3 shows, schematically, an alternative arrangement for a "direct to mains" LED arrangement.

FIG. 3 shows schematically an alternative arrangement for a "direct to mains" LED arrangement; this arrangement is generally similar to that shown in FIG. 2; however, in this configuration each series arrangement of the LEDs strings, that is to say just string 21, or string 21 and string 22 in series, or strings 21, 22 and 23 all in series, are supplied by a different current source, 31, 32 and 33 respectively. Which current source and series combination of strings is in use at any given moment is determined by the setting of the control switch 35.

Figure 4:
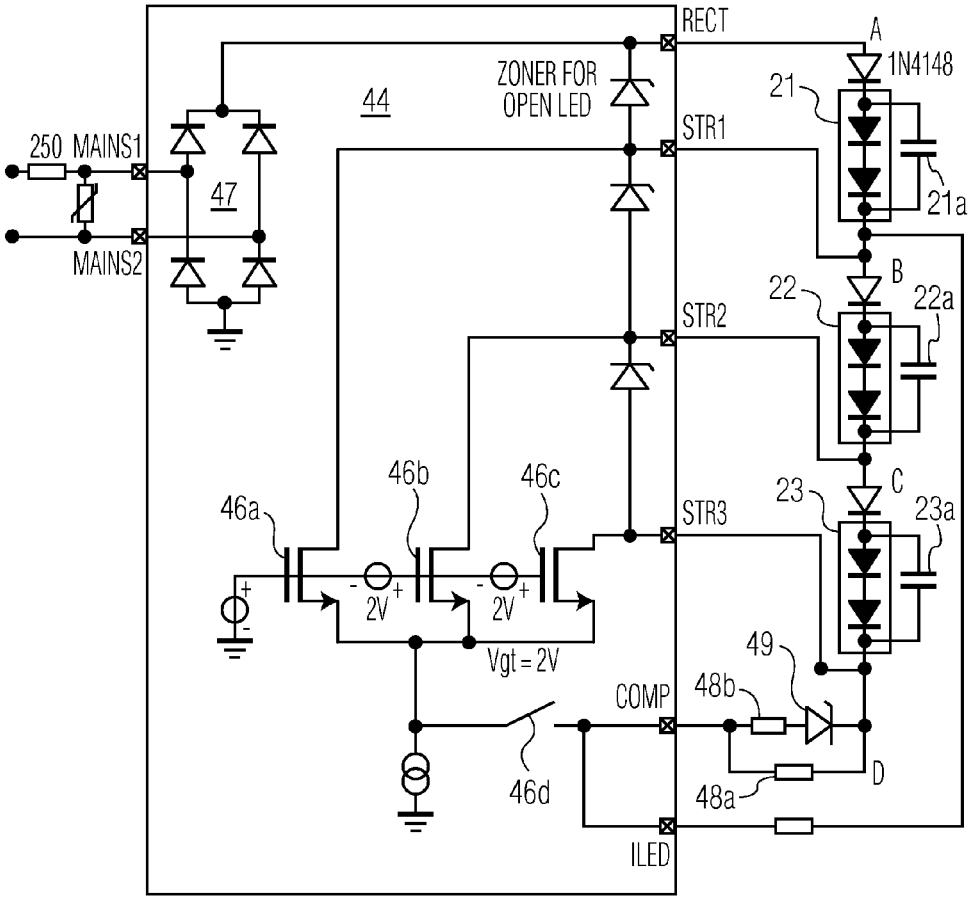
FIG. 4 shows a circuit arrangement for a conventional "direct to mains" LED driver.

A circuit arrangement such as that shown in FIG. 3 is shown in more detail in FIG. 4. FIG. 4 shows a circuit arrangement for a conventional LED driver. The driver 44 includes a full bridge rectifier 47; the switch 26 is shown, in more detail, as the combination of transistors 46*a*, 46*b* and 46*c*. the circuit shown also includes the optional features of a high-voltage switch 46*d* for supplying current through all of the LEDs strings, via either a first heat dissipation resistor 48*a* or a second heat dissipation resistor 48*b* and a Zenor diode, in case of a high mains voltage. The LED current $I_{LED}$ may be set by the ILED pin on the driver, which in this case is connected to node B by a sense resistor Rsense. Although the current-setting may alternatively be effected by a connection to node A, the example shown effectively accommodates current amplitude variation over a mains cycle.

Figure 5:
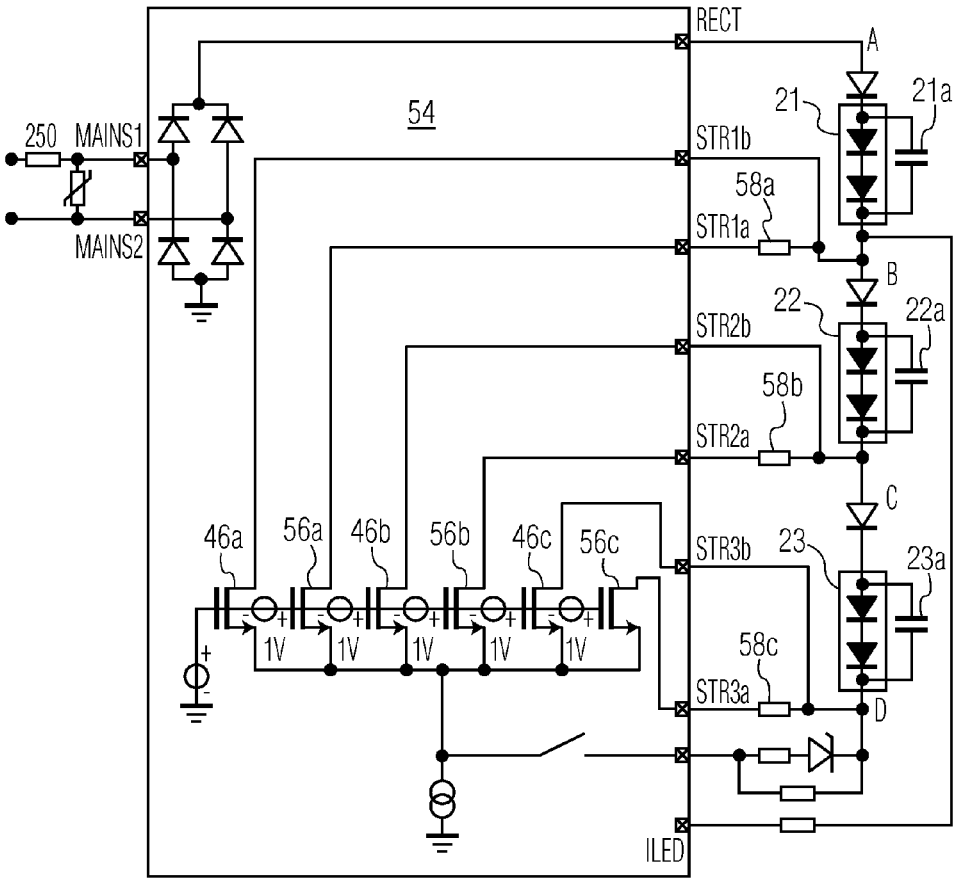
FIG. 5 shows a circuit arrangement according to embodiments of the invention.

FIG. 5 shows a circuit arrangement according to embodiments. In contrast to the circuit shown in FIG. 4 in which current is supplied through a single route for each series arrangements of LEDs strings, such as 46*b* for the two-string combination (that is to say, first and second LED strings in series), in these embodiments current is supplied through two routes 46*b* and 56*b*. Route 46*b* is direct from the switch to node C as in the previous arrangements; however route 56*b* is not directly connected to the node C, but is connected via a power resistor 58*b*. Similarly, Route 46*c* is direct from the switch to node D as in the previous arrangements; however route 56*c* is not directly connected to the node C, but is connected via a power resistor 58*c*.

Similarly, in the case that current is applied to just the single string 21, instead of a single route 46*a* to the node B, there is an additional route 56*a*, which is connected to the node B by a further power resistor 58*a*.

It should be noted that the power resistors 58*a*, 58*b* and 58*c* are external to the driver 54. This may be significant, since typically the driver 54 is packaged as a single semiconductor integrated circuit (IC) or die within a single package. The thermal design of the package must be able to cope with any energy which is dissipated as heat within the IC. By including a route with a power resistor external to the package, it may be arranged that the power dissipated internal to the package is reduced relative to the arrangement shown in FIG. 4. Thus, for the same overall performance, the requirements on the thermal design of the package may be significantly relaxed. This may result in a substantial cost saving. Further, at a system-level it may be possible to position heat-dissipating resistors at a more convenient location than is possible for the driver package—for example on or nearby to a heat-sink.

The operation of an arrangement as shown in FIG. 5 will now be considered in more detail, with reference to FIG. 6, which illustrates the current routing during a half-cycle of the AC supply: for definiteness but without limitation, the parts of the mains cycle during which strings 21 and 22 are both powered will be considered in the following discussion.

The control scheme of the parallel current sources is such that as much as possible current (i.e. up to that at which the voltage across the current source becomes zero) will flow through the "resistor" branch 56*b*. The remaining current flows through the "non-resistor" branch 46*b*. A typical control scheme can be as follows: in case the momentary supply voltage is just sufficient to operate the LEDs and the current source, all current is routed through the path without resistor, that is to say, via 46*b*. As the supply voltage increases to a larger value, current is routed through the path with the resistor as much as possible, such that the additional voltage headroom is over the resistor and thus dissipated outside the IC. When the supply voltage is high enough to enable another LED string (not show in FIG. 5), the current is routed to the next pair of paths.

Figure 6A:
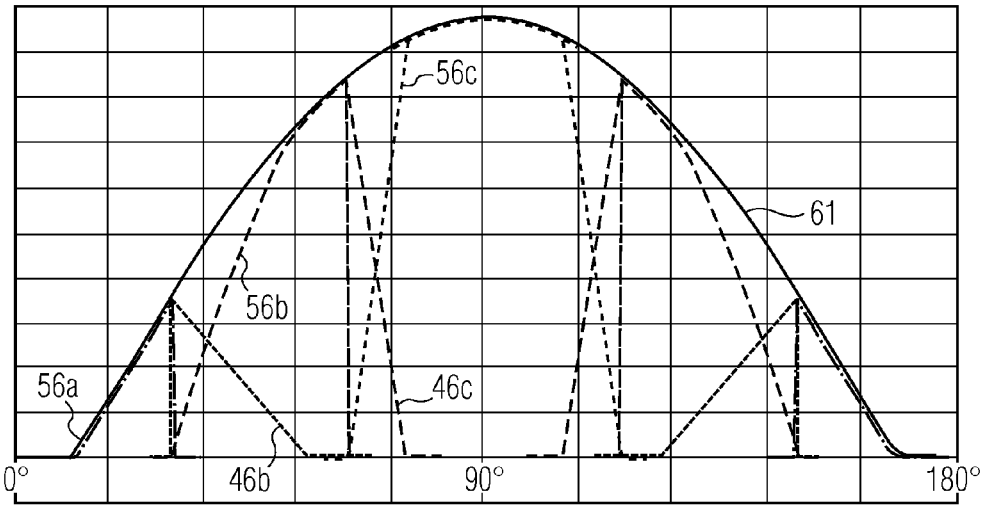
FIG. 6*a* illustrates the current routing during a half-cycle of the AC supply in embodiments.

FIG. 6*a* illustrates this in relation to an arrangement in which there are three strings, and thus six possible current routes, for embodiments in which all the current is routed to just one series arrangement of LED strings. That is to say, this figure is for embodiments in which all of the current is routed to just string 21, OR all of the current is route through both strings 21 and 22, or all of the current is routed through all three strings. That is to say, all of the current is route just just one node B, C or D. By analogy to the route shown in FIG. 5 these are:

46*a* routing to single string 21 without a power resistor in series;

56*a* routing to single string 21 with power resistor 58*a* in series;

46*b* routing to strings 22 and 21, without power series resistor in series;

56*b* routing to strings 22 and 21 with power resistor 58*b* in series;

46*c* routing to strings 23, 22 and 21 without a power resistor in series; and

56*c* routing to strings 23, 22 and 21 with a power resistor 58*c* in series.

It will be appreciated, that when a "route" is described herein, it should be understood to be the route corresponding to the referenced switch 46*a*, 46*b*, etc. Further, it will be noted that route 46*a* is not shown in the figure. By suitable choice of power resistor in routing 65*a*, it may not be necessary to use route 46*a* at all:

At the moment the first string 56*a* starts operating, the LED current is made forced to be proportional to the voltage between the voltage difference between node B and ground, by the signal injected at the Vsense pin. Due to this linear behaviour, a well chosen resistor 58*a* will exactly generate the required current. The voltage across the current source is almost zero, so no or very little power is dissipated during this first state. Then the switch 46*a* is not required and need not be included.

Overall, as shown in the figure, the total current 61 follows a generally sinusoidal shape, although there is no current near the zero crossing of the mains voltage (i.e. near 0° and near 180°), since at least a minimum voltage is required before the first string can be switched on. Although in this example the current is shown as being generally sinusoidal, there is no limitation thereto, and other current profiles are not excluded; for instance and without limitation, the current could be generally linear, sawtooth or even nearly constant or constant within the constraints of htre supplied power. For the remainder of the mains voltage half-cycle, the current is shared between two routes, with the route including a heat-dissipater (56*a*, 56*b*, and 56*c*) taking increasing part of the current, whilst the corresponding route without a power dissipater takes a decreasing part of the current. As discussed above, the "single string" part of the curve is an exception to this as only the heat-dissipation route is shown (or, in some embodiments, required).

It will be appreciated that, although in FIG. 6*a*, instantaneous switch on of the LEDs is shown for clarity, in practice the switch on may not be instantaneous: if the sensitivity/gain for the detection mechanism detecting for operation of the (n+1) string route is low, then there may be a visible crossover point. It has been shown by simulation that a typical cross over time, for a 50 Hz operated system, may be approximately 50 μs. This second cause may be mitigated by including hysteresis.

Figure 6B:
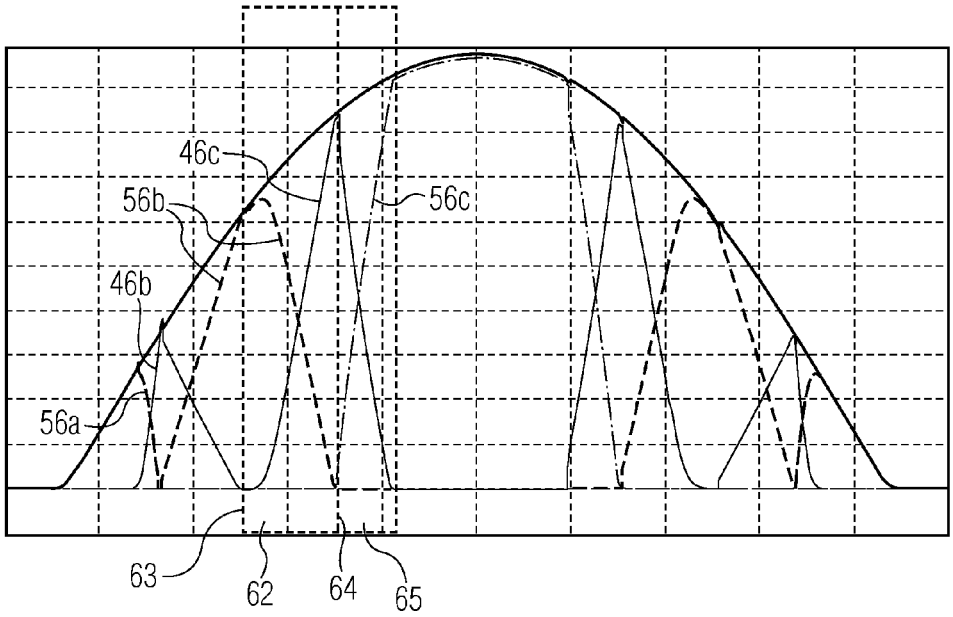
FIG. 6*b* illustrates the current routing during a half-cycle of the AC supply in other embodiments.

FIG. 6*b* shows the currents for an arrangement in which there are three strings, and thus six possible current routes, for embodiments in which the current may be shared between two of the taps B, C, and D. Such embodiments may generally have higher efficiency, than those illustrated by FIG. 6*a*. In such embodiments, there is a voltage transition region, as shown at region 62, where some current is routed to an n-string arrangement, and some current is route to an n+1 string arrangement.

Figure 8:
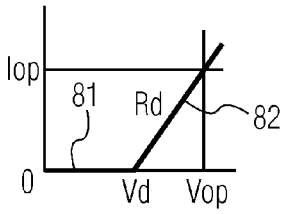
FIG. 8 illustrates a zener/resistor model for an LED.

This may be understood by considering the I-V response of an LED. Hereinabove, an LED has been considered at a pure current sink; however, a more accurate model for an LED is a pure zener diode (that is, a constant voltage drop) with a resistor. This is shown schematically in FIG. 8, which shows the current on the ordinate or y-axis against the voltage on the abscissa or x-axis, for an LED according to such a model. As shown by the flat section 81, the LED does not start to conduct until the voltage across is Vd, which for a typical LED may be around 3V. At higher voltages, the current is increases linearly, as shown at 82, corresponding to a resistance Rd. For an operating current lop, the voltage Vop is determined by the slope of the linear section 82; for a typical LED diode, this voltage may be around 4V.

Returning now to FIG. 6*b*, at the start 63 of the transition region 62 between two-string and three-string operation, all the current is routed through node C, to the two string arrangement via path 56*b* including a heat dissipater. As the voltage increases, the total current through the top two strings is maintained, but part of this current is also routed through the third string. That is to say, the current is shared between node C and node D. So, the top two strings remain fully on (each LED operating at a voltage Vop), whilst the third string is operating at a lower current, since each LED is operating somewhere in the region 82. The end, 64, of region 62 is reached, once the third string is fully turned on—that is to say, once each LED in the third string has current lop. At this voltage, all of the current is route to node D, and none to node C.

The end 64 of region 62 also is the start of region 65, over which the current is shared between the two paths to node D: that (56*c*) with heat dissipater, and that (46*c*) without dissipater, as discussed above in relation to FIG. 6*a*.

Figure 7:
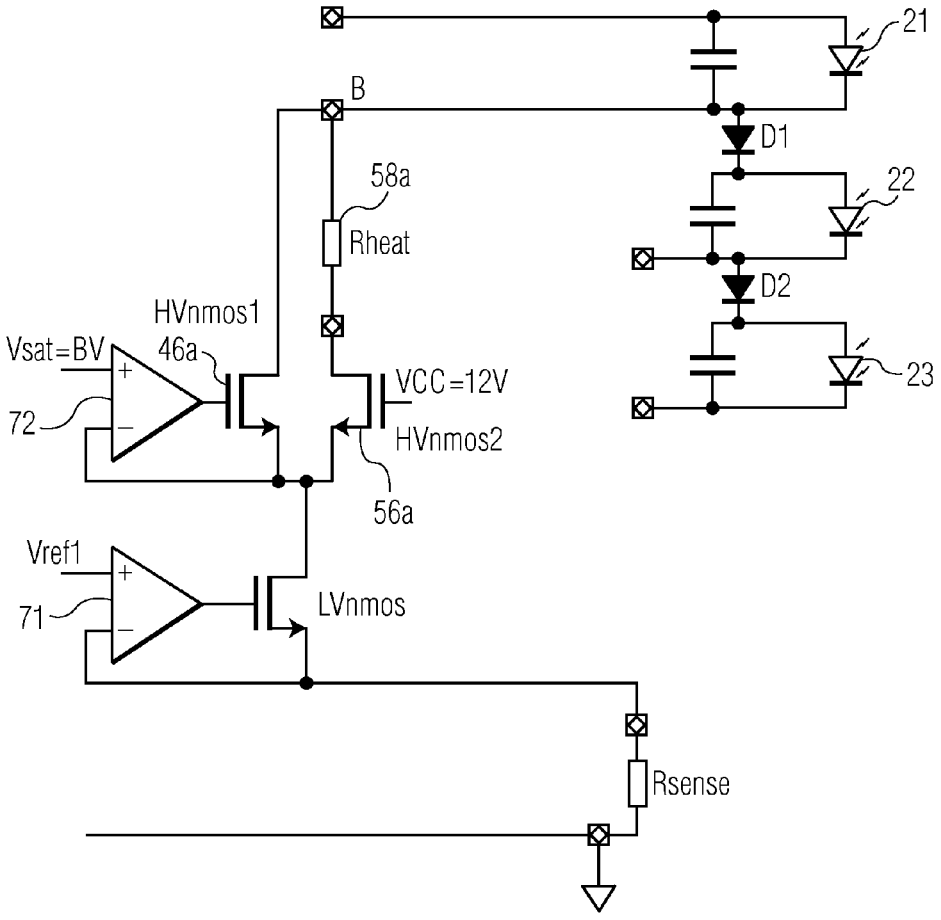
FIG. 7 illustrates a current balancer.

FIG. 7 illustrates operation of a current balancer according to embodiments. The mains is connected to first LED string 21. The figure shows a sense resistor Rsense which is used in conjunction with an error amplifier 71 to establish the string current $I_{LED}$: the main terminals (source and drain in the non-limiting case of a MOS transistor) of a transistor LVnmos are connected in the current path, the control terminal (the gate in the case of a MOS transistor) of the transistor being controlled by the output of an error amplifier 71. One input of error amplifier 71 is connected to a reference voltage Vref1; the other input is connected to the emitter of the transistor. The transistor is controlled to establish the string current according to Vref1/Rsense. It will be appreciated the string current may have linear relationship with the voltage difference between node B and ground—as is also true for the cases shown in FIG. 4-6; alternatively, a constant current, or a relations with some other relationship between the current and the voltage (relative to ground) at node B could be chosen.

The two current routes to the string are firstly via transistor HVnmos1 46*a*, which comprises a first current source, and secondly via a series combination of transistor HVnmos2 56*a* and power resistor Rheat 58*a*. Transistor 56*a* comprises a second current source. The two routes are connected in parallel such that the sources of the transistors 46*a* and 56*a* are commonly connected, and the other end of the two respective routes are commonly connected to node B. The gate of transistor 46*a* is connected to the output of an error amplifier 72. The first input of error amplifier 72 is provided with a reference value of Vsat, which in this example is 3V; the second input to the error amplifier is connected to the common emitters. The gate of transistor 56*a* is connected to an internal supply voltage Vcc, which in this example is 12V.

Ideally, all current will flow through HVnmos2 56*a* (and consequently through the external resistor Rheat 58*a*). However when this current is not sufficient (i.e. when it is smaller than Vref1/Rsense), the source voltages of HVnmos1&2 will start to fall. The error amplifier 72 prevents the voltage at the common emitters from going below the reference value, which in this non-limiting example case is 3V, by switching on HVNDMOS1 in such a way that the total current matches Vref1/Rsense again.

The current balancer described with FIG. 7 is for balancing the current between the two routes to supply first string 21 only; however, the skilled person will appreciate that similar configurations may be used to balance the current between the two respective routes to supply first and second strings 21 and 22, or all three strings 21, 22 and 23.

In an example system where are the circuit is provided for driving a 10 W LED lamp typical efficiencies achievable by linear LED drivers that may be around 80%. This may result in around 2 W of thermal dissipation. According to embodiments described herein, it may be possible to transfer around two thirds of this into the heat dissipaters, and as a result the specification for the die package for the driver/controller may be relaxed, such that it need only be able to dissipate 0.75 W of heat, rather than to what which may have been the case according to conventional circuits.

Further, the skilled person would appreciate that although in FIG. 7 there is shown one direct route and one route having a power resistor, the invention is not limited thereto, and in other embodiments there may be one or more further routes each having a power resistor with different resistance. By choosing different resistance values of the heat dissipaters, the balancing of routing can be effected so that more of the current is supplied by paths with a heat dissipater (as the voltage rises, firstly through that with a low resistance value and progressive through that or those with a higher resistance value) Furthermore, it will be appreciated that although as discussed herein, a single resistor 58*a*, 58*b*, 58*c* is provided as the heat dissipated, in embodiments the single resistor may be replaced by two or more resistors or resistive components. A non-limiting example of such a resistive component, which would be familiar to the skilled person, is a MOSFET biased in it's linear regime.

It will be appreciated, that although in general herein the term "mains" is used to describe the AC power supply, the invention is not limited thereto and extends to circuits for use with other AC supplies, such as without limitation those generated by an alternator.

It will be appreciated that by the term power resistor, is meant a resistor which is designed so as to be able to dissipate a significant level of power, such as without limitation 0.5 W or 2 W, without damage or deterioration to the device.

By the AC voltage, is meant the voltage momentarily supplied by the AC supply. It appreciated that the AC voltage varies over the cycle of the AC supply.

It will be further appreciated that, when used herein, the term "LED" should be interpreted broadly to include solid-state diodes, organic LEDs (OLED), and the like.

From reading the present disclosure, other variations and modifications will be apparent to the skilled person. Such variations and modifications may involve equivalent and other features which are already known in the art of LED driver circuits, and which may be used instead of, or in addition to, features already described herein.

Although the appended claims are directed to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable sub-combination.

The applicant hereby gives notice that new claims may be formulated to such features and/or combinations of such features during the prosecution of the present application or of any further application derived therefrom.

For the sake of completeness it is also stated that the term "comprising" does not exclude other elements or steps, the term "a" or "an" does not exclude a plurality, a single processor or other unit may fulfil the functions of several means recited in the claims and reference signs in the claims shall not be construed as limiting the scope of the claims.

The invention claimed is:

1. A circuit, for driving a plurality of LED strings from an AC supply and arranged to, in use, drive current through a series arrangement of a plurality (N) of the LED strings when the AC voltage is sufficient to drive the plurality (N) of the LED strings: the circuit comprising a first current source configured to be switchably connected to said series arrangement of N LED strings;

a series combination of a second current source and a heat dissipater, wherein the series combination of the second current source and the heat dissipater is arranged in parallel with the first current source; and a current balancer for balancing the current through the first current source and the second current source;

wherein the first current source comprises a first transistor and the second current source comprises a second transistor, the first and second transistors having commonly connected emitters;

the circuit further configured such that in use the sum of the currents $I_1$ and $I_2$ through the first and second current source is controlled by a voltage reference $V_{ref}$ and a sense resistance $R_{sense}$, according to $$I_1+I_2=V_{ref}/R_{sense}$$

and the current balancer is operable to control the second transistor to control I1 in dependence on a voltage at the commonly connected emitters.

2. A circuit as claimed in claim 1, further comprising at least one further series combination of a respective further current source and a respective further heat dissipater, wherein the further series combination is arranged in parallel with the first current source, and wherein the current balancer is configured to balance the current through the first current source, and second current source and the at least one further current source.

3. A circuit as claimed in claim 1, wherein the plurality of LED strings consists of 2 LED strings.

4. A circuit as claimed in claim 1, wherein, in use, (N) increases with increasing voltage of the AC supply to a maximum (M), such that when the plurality (N) is equal to the maximum (M) the entire plurality of LED strings are driven.

5. A circuit as claimed in claim 1, configured such that, in use, when the AC voltage is sufficient to drive one LED string only, current is supplied to the LED string only through a series combination of a current source and a heat dissipater.

6. A circuit as claimed in claim 4, comprising, for each different value of the plurality (N), different first current sources and different series combinations of second current source and heat dissipater.

7. A circuit as claimed in claim 4, wherein the maximum (M) is between 2 and 3.

8. An LED driver configured for use in a circuit according to claim 1 and comprising;

the first current source;

the second current source; and the current balancer for balancing the current through the first current source and the second current source.

9. An LED driver configured for use in a circuit according to claim 2 and comprising;

the first current source;

the second current source;

the at least one further current source; and the current balancer for balancing the current through the first current source, the second current source and the at least one further current source.

10. A method of driving a plurality of LED strings from an AC supply and comprising:

driving current through a series arrangement of a plurality N of the LED strings when the AC voltage is sufficient to drive the plurality N of the LED strings, and balancing the current through a first current source and a second current source;

wherein the first current source is configured to be switchably connected to said series arrangement of the plurality (N) of LED strings, and a series combination of the second current source and a heat dissipater is arranged in parallel with the first current source;

wherein the first current source comprises a first transistor and the second current source comprises a second transistor, the first and second transistors having commonly connected emitters;

the circuit further configured such that in use the sum of the currents $I_1$ and $I_2$ through the first and second current source is controlled by a voltage reference $V_{ref}$ and a sense resistance $R_{sense}$, according to $$I_1+I_2=V_{ref}/R_{sense}$$

and the current balancer is operable to control the second transistor to control I1 in dependence on a voltage at the commonly connected emitters.

11. A circuit as claimed in claim 1, wherein the circuit is packaged as a single semiconductor integrated circuit (IC) or as a single die within a single package except for the heat dissipater, which heat dissipater is external to the single semiconductor IC or the single package.

12. A circuit as claimed in claim 1, wherein:

the second current source comprises two routes, one route which includes the first heat dissipater and one parallel route that does not include the first heat dissipater; and the third current source comprises two routes, one route which includes the second heat dissipater and one parallel route that does not include the second heat dissipater.

13. A circuit, for driving a plurality of LED strings from an AC supply and arranged to, in use, drive current through a series arrangement of a plurality (N) of the LED strings when the AC voltage is sufficient to drive the plurality (N) of the LED strings, the circuit comprising:

a first current source configured to be switchably connected to said series arrangement of N LED strings;

a series combination of a second current source and a first heat dissipater configured to be switchably connected to said series arrangement of N LED strings;

a series combination of a third current source and a second heat dissipater configured to be switchably connected to said series arrangement of N LED strings;

wherein the first current source, the series combination of the second current source and the first heat dissipater, and the series combination of the third current source and the second heat dissipater are arranged in parallel with each other; and a current balancer for balancing the current through the first current source, the second current source, and the third current source.

14. A circuit as claimed in claim 13, wherein:

the second current source comprises two routes, one route which includes the first heat dissipater and one parallel route that does not include the first heat dissipater; and the third current source comprises two routes, one route which includes the second heat dissipater and one parallel route that does not include the second heat dissipater.

15. A circuit as claimed in claim 14, wherein:

wherein the first current source comprises a first transistor and the second current source comprises a second transistor, the first and second transistors having commonly connected emitters;

the circuit further configured such that in use the sum of the currents $I_1$ and $I_2$ through the first and second current source is controlled by a voltage reference $V_{ref}$ and a sense resistance $R_{sense}$, according to $$I_1+I_2=V_{ref}/R_{sense}$$

and the current balancer is operable to control the second transistor to control I1 in dependence on a voltage at the commonly connected emitters.

* * * * *